United States Patent [19]

Killilea et al.

[11] Patent Number: 5,062,334

[45] Date of Patent: Nov. 5, 1991

[54] APPARATUS FOR CLEANING CUTTING TABLE SUPPORT SURFACE

[76] Inventors: Timothy R. Killilea, 5636 W. Reighmoor Rd., Omro, Wis. 54963; David W. Sattler, Rte. 1, Box 161, Pine River, Wis. 54965

[21] Appl. No.: 527,071

[22] Filed: May 21, 1990

[51] Int. Cl.[5] ..... B26D 7/18

[52] U.S. Cl. ..... 83/99; 83/100; 83/168; 83/451; 83/941; 210/496; 210/497.001

[58] Field of Search ..... 83/100, 168, 374, 451, 83/940, 941, 99, 169; 210/496, 497.1

[56] References Cited

U.S. PATENT DOCUMENTS

| | | | |
|---|---|---|---|
| 3,877,334 | 4/1975 | Gerber | 83/169 X |
| 3,880,047 | 4/1975 | Dosier | 83/451 X |
| 3,942,411 | 3/1976 | Gerber | 83/941 X |
| 4,345,496 | 8/1982 | Pearl | 83/100 |
| 4,382,728 | 5/1983 | Anderson et al. | 83/940 X |
| 4,494,433 | 1/1985 | Gerber | 83/100 X |
| 4,560,478 | 12/1985 | Narumiya | 210/496 |
| 4,730,526 | 3/1988 | Pearl et al. | 83/76.1 |
| 4,836,923 | 6/1989 | Popoff et al. | 210/497.01 X |

*Primary Examiner*—Frank T. Yost
*Assistant Examiner*—Kenneth E. Peterson
*Attorney, Agent, or Firm*—R. Jonathan Peters

[57] ABSTRACT

There is provided a sweeper for cleaning the support surface of a machine for cutting sheet material and having a vacuum chamber disposed below said support surface to hold down the sheet material during cutting, and a carriage assembly, supported above said support surface for longitudinal and transverse movement relative to said support surface. The sweeper has a nozzle mounted on said carriage assembly and is adaptable for contacting the support surface, and includes a conduit in fluid communication to a vacuum generator. A filter is disposed in a housing intermediate said nozzle and the vacuum generator, and a valve is provided for by-passing vacuum to the vacuum chamber and opening vacuum to said sweeper for cleaning said support surface.

13 Claims, 3 Drawing Sheets

APPARATUS FOR CLEANING CUTTING TABLE SUPPORT SURFACE

FIELD OF THE INVENTION

This invention relates to a cutting machine. In its more specific aspect, this invention relates to an apparatus for cleaning the support surface of a cutting machine, and more particularly the support surface of a machine for cutting a layup of sheet material.

BACKGROUND

Machines for cutting a layup of flat web material or sheet material, such as a cloth pattern cutter, are well known and used extensively. This type of machine comprises a cutting table having a support surface for the sheet material, and usually includes an infeed or layup table and a take-off platform or device. The support surface, which may be a continuous or endless belt, is at least in part air-permeable, and a vacuum holddown system is disposed beneath the support surface on which the sheet material is positioned for cutting. When vacuum is applied to the material, the material is held in position on the table to perform the cutting with greater ease and accuracy. Carrier means positioned above the table moves longitudinally and transversely relative to the table, and an instrument such as a cutting knife, drilling tool, stylus, etc., is mounted to the carrier means. The machines today typically are automatically controlled such as from programmed data.

Sheet materials that can be cut on machines of this type include woven and non-woven fabrics, leather, paper, plastics, and the like. The pattern pieces are cut in a single operation by first laying the sheet material in a multi-ply stack called a layup, and then cutting the pattern pieces from the layup. Conveyorized cutting tables having a length less than the overall length of a single layup are commonly used and cut the layup in two or more sequential segments. In order to conserve energy, a zoned cutting table has been developed whereby vacuum is applied only to a limited portion of the layup where the instrument, e.g., cutting blade is operating.

In a cutting machine of this type, the cutting instrument must pass through the layup so that all patterns cut from the layup will be substantially identical. The support surface therefore should be permeable to the cutting instrument. For this purpose, bristle mats, which are air-permeable, have been used successfully as the support surface. The support surface or cutting surface of the mat comprises a plurality of vertically packed plastic bristles extending from a perforated pad or base. When a vacuum is applied to the underside of the mat, the perforations allow the vacuum to pass through the bristles and thereby hold the sheet material in place for cutting. Further, the bristles provide a permeable cutting surface so that the cutting instrument, e.g. knife, can pass through all the sheet material in the layup and into the bristle zone and move and turn freely.

A layup of sheet material such as fabric is held down on the bristle mat by vacuum during the cutting operation, and loose lint, thread, and small fragments of scrap are drawn into the mat and accumulate between the bristles and clog the perforations in the base. As a consequence, the holddown efficiency of the mat is reduced in that as the layup is cut, the sheet material will shift therefore resulting in nonuniformity. Further, this build-up of debris causes the individual bristles to bend away from the vertical plane. As the knife blade passes through the bent bristles, the blade cuts off the bristles. This causes gaps in the bristle block, which allows a greater build-up of debris and increasingly larger gaps. The sheet material sags into the gaps, and the cutting quality is impaired. If the bristles are cutoff, the square must be replaced, which is costly to the operator.

It therefore is necessary to keep the mat clean of this debris. A sweeping mechanism for cleaning the accumulation between bristles is disclosed in U.S. Pat. No. 4,345,496 to David R. Pearl. In accordance with the teachings of that patent, the bristle mat is provided as an endless belt. During the moving mode of transferring a layup along the table, the bristle mat passes beneath the table, and a portion of the mat is contacted with a vacuum sweeper, which is controlled through a series of valves, ports and partitions. The arrangement appears to be relatively complicated, and is applicable only to an endless or continuous table.

This invention has therefore as its purpose to provide an apparatus for cleaning a support surface such as a bristle mat, used in layup cutting, whether for a fixed or endless table, and which is easy to utilize.

SUMMARY OF THE INVENTION

In accordance with the present invention, there is provided a layup cutting machine having a working table or cutting table with an air-permeable support surface for supporting a layup of sheet material. A cutting or marking instrument is affixed to a carrier means mounted above the support surface and is adaptable to traverse at least a portion of the support surface. A vacuum generating means is positioned below the support surface so that when a vacuum is drawn, the sheet material is held down on the support surface. A sweeper means is mounted on the carrier means and is adaptable for contacting at least a portion of the support surface. The sweeper means is in fluid communication with the vacuum generating means to draw a vacuum upwardly through the support surface. When it is necessary or desirable to clean the support surface, the cutting operation is interrupted or discontinued. Valve means cuts off the vacuum drawn on the underside of the support surface to hold down the webbing and opens the vacuum to the sweeper means. Carrier means traverses at least a part of the support surface, thereby sweeping the support surface clean of debris.

In one embodiment of the invention, the support surface comprises a bristle mat having a perforated base and upwardly extending pliable bristles. The horizontal plane formed by the top ends of the bristles defines the support surface for the sheet material. Lint, thread, tiny fragments or pieces of the web, and other such debris get lodged in the bristle mat between the bristles and in the perforations. As a consequence, the holddown vacuum is diminished, and also the bristle block can be damaged. Our invention is useful in cleaning the bristle pad by re-routing the vacuum in a direction opposed to the holddown vacuum, and utilizing the X and Y coordinate movements of the carrier means to direct the sweeper in traversing the mat. It, therefore, is possible to sweep the bristle mat clean of debris. Further, the invention obviates the use of any complex arrangement of valves and ports such as shown in the prior art.

In another embodiment of the invention, a filter means is positioned intermediate the sweeper means and the vacuum generating means of the cutting machine.

During the cleaning operation, the vacuum is re-routed from the holddown position so as to draw a vacuum on the sweeper means, and air passes through the filter means before entering the vacuum generating means. In this manner, the debris is trapped by the filter instead of passing to the generating means or to the atmosphere.

DETAILED DESCRIPTION OF THE INVENTION

Figure 1:
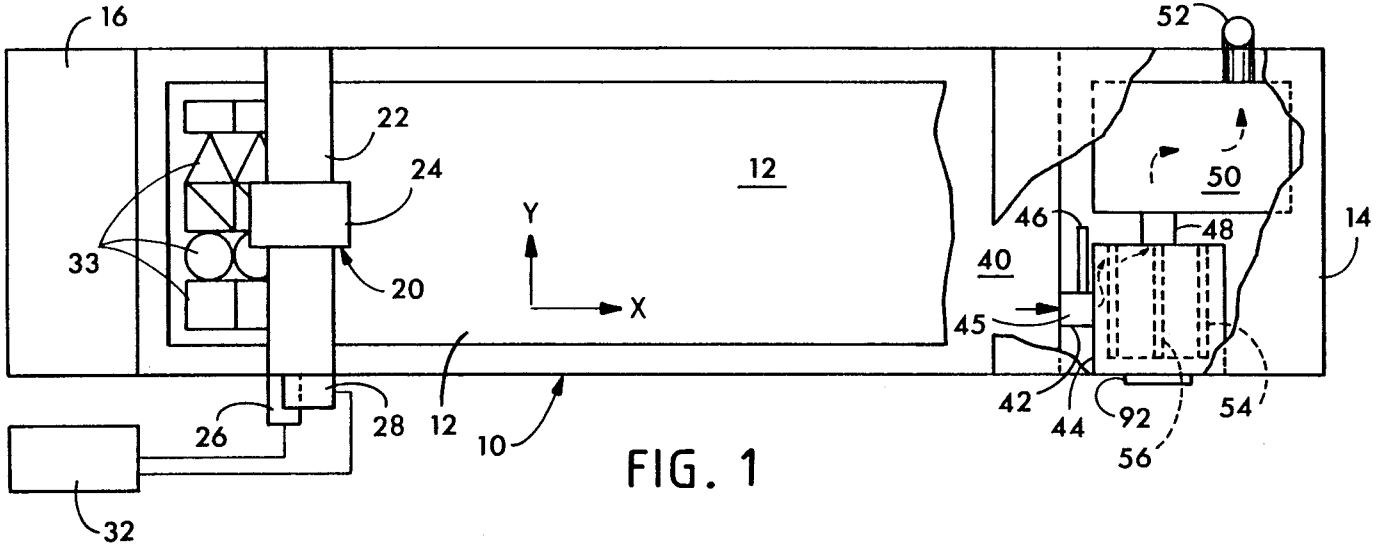
FIG. 1 is a plan view of a conventional machine for cutting a layup of sheet material. A portion of the table has been broken away to show otherwise hidden structural features.

Referring to the drawings, which are somewhat schematic, wherein like numerals refer to similar parts throughout the various views, there is shown a conventional cutting table, indicated generally by the numeral 10, suitable for cutting web-like material comprising several superposed sheets of layup 12. The machine shown in the drawings for illustrative purposes only may be a static table or a continuous or endless belt machine, but it should be understood that the invention is applicable to both as will become apparent from the description of the invention below. The sheet material, typically as for an endless belt machine, is fed to the cutting machine or work area of the cutting table from a take-on platform or feed table 14, and the material leaves the table onto a take-off platform or device 16.

The layup 12 is supported on the cutting table by a bristle mat or belt 18, which typically comprises a plurality of bristle blocks or squares 19 (described herein below in detail) carried by a grid or support rails (not shown). Although a static table is shown, the bristle mat may be a continuous or endless belt passed around suitable spaced rollers extending transversely of the material conveying direction at either end of the cutting table. Cutting tables of the type applicable to our invention are well known and commercially available, and are disclosed in U.S. Pat. Nos. 3,495,492; 4,328,726; 4,345,496; 4,434,691; and 4,476,756 all assigned to Gerber Garment Technology, Inc.

Carriage assembly, indicated generally by the numeral 20, is supported above the cutting table 10 in the work area for movement in both a longitudinal and transverse direction relative to the table. In a conventional machine, the carriage assembly comprises a carrier beam 22 extending transversely of the table and spaced therefrom, and a cutting head 24 mounted on the carrier beam. The carrier beam, driven by motor means 26, is adaptable to move in a longitudinal or X-coordinate direction on suitable side rails (not shown), and the cutting head is provided with an electromotor 28 to impart movement to the cutting head along the beam in a transverse or Y-coordinate direction. The movement of the carriage assembly is computer controlled, and the carrier beam and cutting head move in response to signals from a computer shown schematically as 32. During a cutting operation, the layup is positioned on the bristle mat, and the carriage assembly tranverses substantially the entire cutting area in order to cut a pattern 33 in the sheet material. Thus, the carrier beam moves longitudinally along the work area, and simultaneously the cutting head moves transversely as the blade is moved in various directions, all as programmed by the computer.

Figure 5:
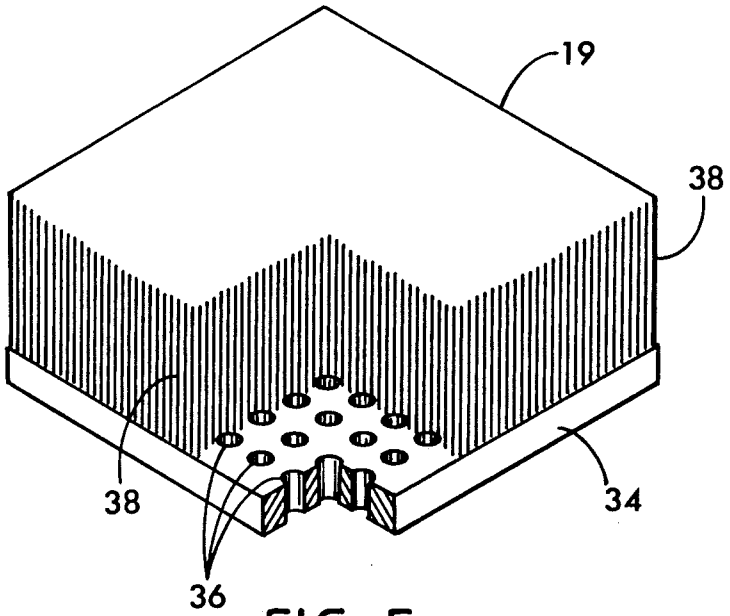
FIG. 5 is a perspective view of a bristle square, but partly broken away to better illustrate certain features of the bristle square.

Referring now to FIG. 5, there is shown in detail a bristle block or square 19, and the drawing shows a portion of the bristles removed in order to show the details of the square. It should be understood that the bristle mat or belt comprises a plurality of bristle squares, affixed in abutting relation to a grid to define a common horizontal plane or support surface for the layup. Each bristle block is molded from plastic material and includes a base 34 having a plurality of perforations 36 and a large number of bristles 38 integrally connected to and projecting upwardly from the base.

Vacuum chamber 40, formed intergrally with the cutting table, is disposed below the bristle belt 18 in the cutting region and communicates with the holes 36 in the bristle squares 19. Chamber 40 is appropriately sealed along its longitudinal and transverse sides, and one or more air conduits or ducts 42 leads from the vacuum chamber to filter housing 44. At the juncture between the air duct and the wall of the housing, there is provided a port or opening 45, and an appropriate closure member 46 (shown in open position), such as a suitable valve means, plate, partition, or the like, is operated to open or close fluid communication between the vacuum chamber and the housing. Thus, during the cutting operation, the closure member 46 remains open (as shown in FIG. 1) in order to provide a holddown vacuum for the layup, as explained below in greater detail. Where desired, the closure member 46 may be incorporated into the air duct 42. Housing 44 is in turn connected via air conduit or duct 48 to vacuum generator 50. Air from the generator is vented to the atmosphere via duct 52. The vacuum generator is a conventional apparatus, and may comprise a motor driven turbine. Housing 44 is provided with a cylindrical shaped filter 54 concentrically arranged in the housing and supported by bracket 56. In this manner, air drawn through the housing impinges on the outside wall of the filter and exits from the opposite or inside of the cylinder through duct 48. Hence, the outside wall of the filter catches the lint and other debris carried by the air stream so as to prevent this material from damaging the vacuum generator and to exhaust clean air.

Figure 3:
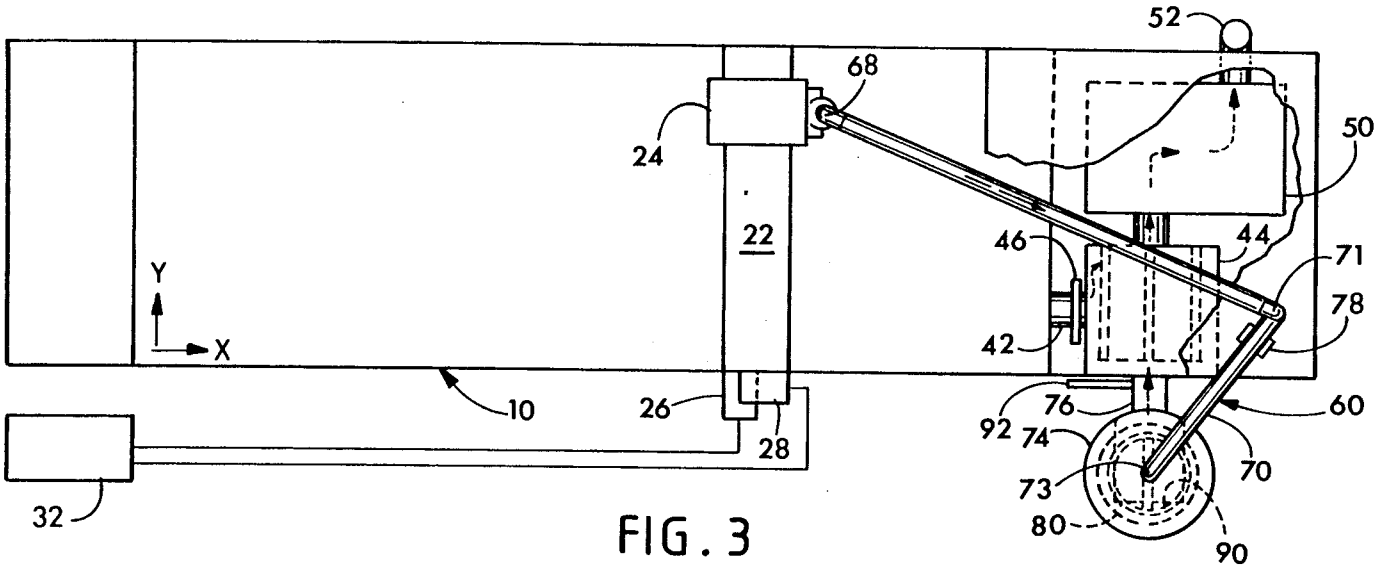
FIG. 3 is a plan view of the machine of FIG. 1, partly broken away to show certain structural features, but modified to incorporate the apparatus of the present invention.
Figure 4:
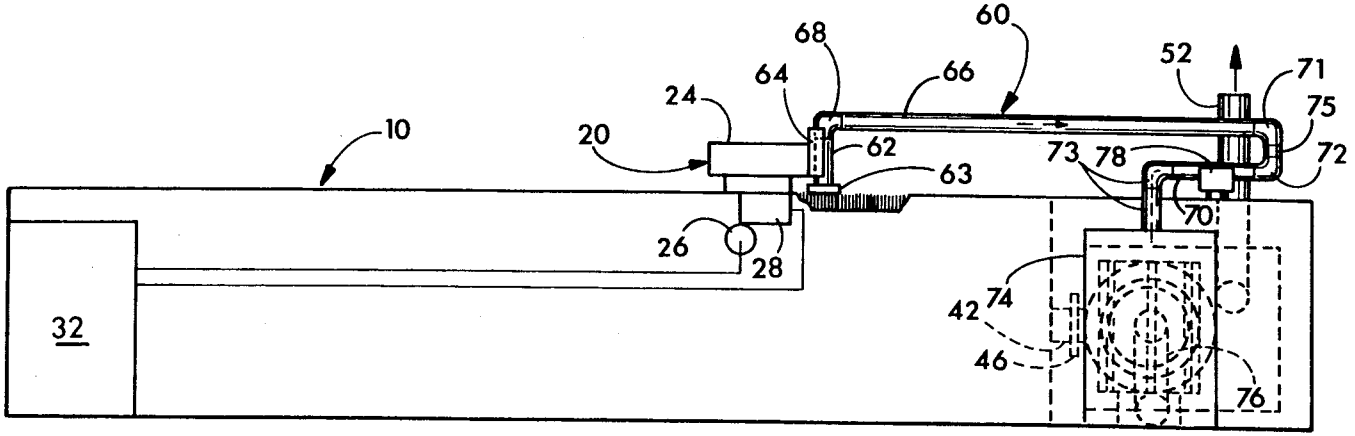
FIG. 4 is a side elevational view of the machine of FIG. 3 showing the present invention.

Referring now to FIGS. 3 and 4, there is shown a sweeper means indicated generally by the numeral 60. In a preferred embodiment of the invention, the sweeper comprises elongated tubing, including a nozzle 62, in fluid communication with the vacuum generating means. Where desired, nozzle 62 may be provided with an annular flange or ring 63. The sweeper nozzle is connected to the carriage assembly 20 which is mounted for movement along the X and Y coordinates, and therefore the sweeper with the connecting nozzle will likewise traverse a portion of the bristle mat in a sweeping operation. Accordingly, cutting head 24 is provided with a bracket or saddle 64, and nozzle 62 of the sweeper is mounted onto the bracket. Desirably, bracket 64 has a configuration which is complementary to the nozzle in order to more firmly seat the nozzle, and if the nozzle has a convex shape such as that of a tube, the bracket desirably has a complementary concave facing. The nozzle is seated on the bracket with the inlet in contact with the support surface defined by the bristle mat so that as the sweeper moves across the mat, the air flow agitates the bristles thereby aiding in removing the debris. The tubing for the sweeper should be rigid for otherwise the tubing would collapse when a vacuum is drawn. For this purpose, the tubing, including the nozzle and elbows, may be of metal, plastic such as polyvinyl chloride, or fabric reinforced with metal mesh windings. In a preferred embodiment, the tubing is polyvinyl chloride, and because the plastic tubing is rigid, the tubing is provided in a plurality of sections which are pivotally connected by elbows means so that the nozzle, carried by the cutting head, can traverse both the X and Y coordinates of the table. Thus, first tubing section 66 is pivotally connected to nozzle 62 by elbow means 68, and again is pivotally connected to second tubing section 70 by elbows means 71 and 72 and coupled at 75. Section 70 is pivotally connected by elbow coupler 73 to a second filter housing 74 disposed adjacent to and upstream of filter housing 44. Housing 74 is in fluid communication with housing 44 via air duct 76, and thence to the vacuum generator 50 as explained above. In this manner, a vacuum can be drawn on the sweeper as explained below. Because of the length of the tubing, it is preferable to support the second section of tubing 70 with a dolly 78 positioned at the feed means for the cutting table so as not to ride on the bristle mat. It should be understood that although the sweeper tubing with two sections and connecting elbows is shown, the tubing for the sweeper may be provided in three or more sections, such as for cleaning a static table where it may be necessary to extend the overall length of the sweeper. As a further modification of cleaning a static table, duct 76 may be extended as by adding additional sections, and housing 74 may be positioned along the length of the table depending on the position of the sweeper nozzle.

Figure 7:
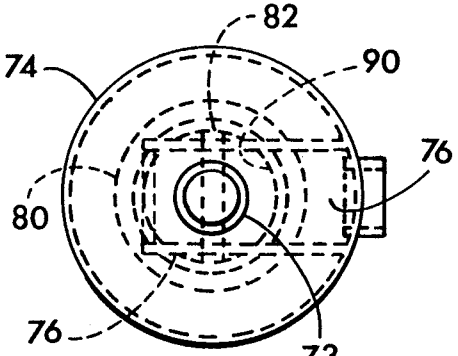
FIG. 7 is a plan view of the filter means of FIG. 6.
Figure 6:
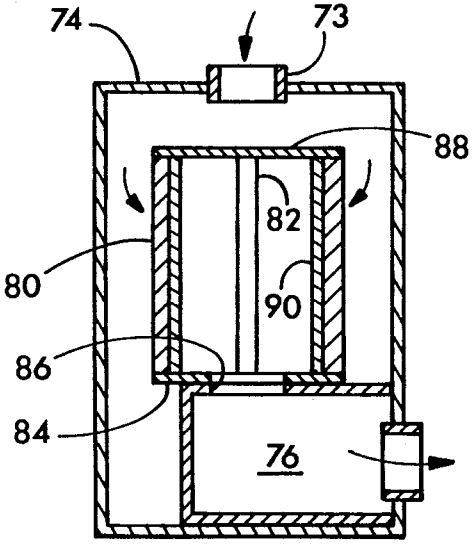
FIG. 6 is a longitudinal sectional view of the auxiliary air filter means.

Filter housing 74 is provided with a filter 80 (see FIGS. 6 and 7), which is auxilliary to filter 54 and is disposed upstream thereof. Filter 80 preferably is of a substantially cylinderical configuration, and is concentrically arranged in the housing and supported on bracket 82 that seats on base plate 84 having an opening 86 to provide fluid communication with duct 76. It is understood that a filter of substantially cylinderical configuration is not limited to a cylinder of circular cross-section, but is intended also to include a cylinder of eleptical or polygonal (rectangular, pentagonal, etc.) cross-section. The opposed end of the bracket supports a top plate 88, and the plate is connected to the bracket as by conventional means such as a threaded nut and bolt (not shown). In this manner, the filter is secured in position between the two spaced plates. The tubing 70 enters housing 74 through elbow coupler 73 pivotally connected to the top wall of the housing. Air drawn through the sweeper enters the housing 74, impinges on the outer wall surface of the filter, and exits the filter via duct 76 extending from the opening in base plate 84, as shown by the arrows in FIG. 6. The filter should be sufficiently rigid so as not to collapse when a vacuum is applied during the sweeping operation. In a preferred embodiment, the filter comprises a one inch polyester open cell foam fitted over a concentrically arranged, reticulated metal cylinder 90. A suitable closure member 92, such as valve or plate, is provided for housing 44 to block off the flow of air into the housing 74 during the cutting operation. Where desired, closure member 92 may be omitted, and duct 76 can be disconnected from the housing 44 during the cutting operation, and a plate or cover inserted to block the opening. During the sweeping operation, closure member 92 is opened and closure member 46 is closed, and the vacuum applied is re-routed through the sweeper means. Where desired, during the cutting operation, the sweeper may be disconnected from the machine, the valves opened in the proper order, and a holddown vacuum applied to the bristle mat.

Figure 9:
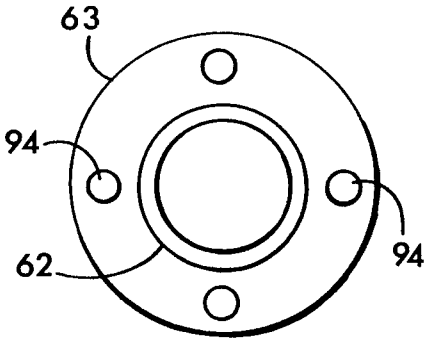
FIG. 9 is a plan view of the nozzle of FIG. 8.
Figure 8:
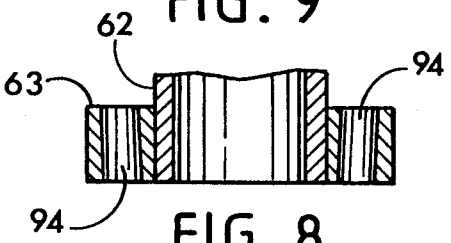
FIG. 8 is a fragmentary, longitudinal sectional view of the nozzle.

Referring to FIGS. 8 and 9, there is shown an alternative embodiment for the nozzle 62 having an outwardly disposed annulus 63. Further, this annular flange may be provided with one or more transverse orifices 94, which preferably are angled inwardly relative to the longitudinal axis of the nozzle. During the sweeping operation, compressed air is blown through the openings 94 and into the bristles, thereby agitating the bristles and debris, which aids in cleaning the squares.

Figure 2:
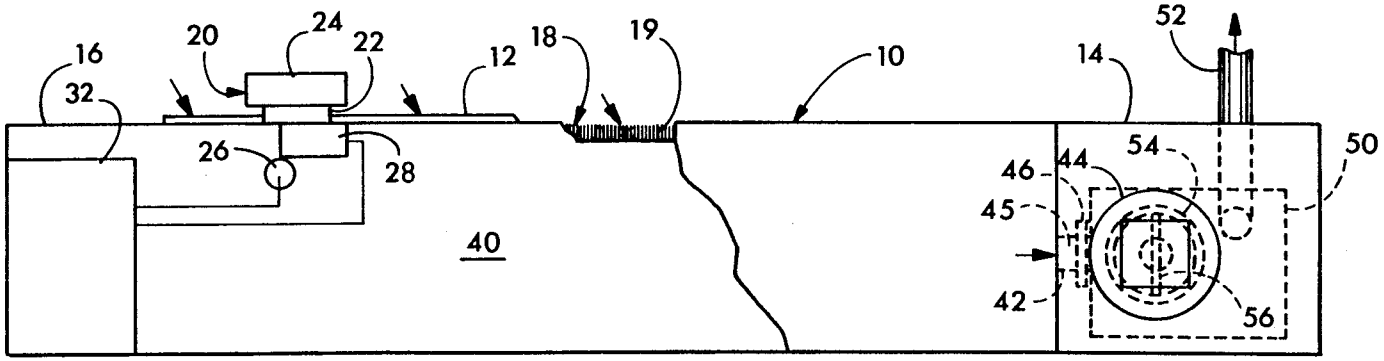
FIG. 2 is a side elevational view of the cutting machine of FIG. 1.

In the operation of the machine, a layup of sheet material is fed to the work area of the cutting table 10. Closure member 46 is opened to permit air passageway through duct 42, and valve member 92 is closed, thereby establishing communication between the air chamber 40 and vacuum generator 50. When a vacuum is drawn, with the flow of air as shown by the arrows in FIGS. 1 and 2, the layup is held in place on the bristle mat 18, and the sheet material is cut in accordance with a computer program. When the cutting operation is completed, and it is desirable to clean the bristle mat of lint and other such debris, the sweeper 60 is setup by attaching nozzle 62 to bracket 64 so that the terminus of the nozzle contacts the bristle mat, closing valve member 46 and opening valve member 92. Thus, the vacuum is re-routed through the sweeper 60 and housing 74. A computer program controls the movement of the carriage assembly 20 which has affixed to it nozzle 62, and is programmed to move the cutting head 24 in the Y-coordinate direction across the width of the mat and the carrier beam 22 in the X-coordinate direction. After each pass of the cutting head across the width of the mat, the carrier beam advances along the X-coordinate for an increment about equal to, or less than, the width of the nozzle. This transvers and longitudinal movement of the sweeper is continued until the bristle mat has been swept. If an endless belt machine is to be cleaned, the bristle mat can be cleaned in sections, and as one section has been cleaned, the mat is advanced so that an adjacent section can be cleaned.

Having thus described the invention generally and in terms of specific embodiments thereof, we claim:

1. Apparatus for cutting sheet material comprising:

(a) a cutting table including an air-permeable support surface for said sheet material, and a vacuum chamber disposed below said support surface;

(b) carrier means, including cutting means, supported above said support surface for longitudinal and transverse movement relative to said table;

(c) vacuum generating means including fluid communication means to said vacuum chamber for applying a vacuum to hold down said sheet material on said support surface during cutting operation;

(d) sweeper means mounted on said carrier means and adaptable for contacting said support surface, and including fluid communication means to said vacuum generating means; and (e) valve means for cutting off vacuum to said vacuum chamber and opening vacuum to said sweeper means for cleaning said support surface.

2. Apparatus according to claim 1 wherein said support surface comprises a bristle mat mounted on said cutting table and having a perforated base and a plurality of upwardly extending pliable bristles defining the support surface for the sheet material.

3. Apparatus according to claim 1 wherein said fluid communication means to said housing includes a conduit means pivotally mounted to said vacuum generating means and extending from said carrier means to said vacuum generating means.

4. Apparatus according to claim 1 including a filter means disposed intermediate said sweeper means and said vacuum generating means.

5. Apparatus according to claim 1 wherein said sweeper means comprises a nozzle with an inlet mounted to said carrier means, filter means having opposed surfaces and disposed intermediate said nozzle and said vacuum generating means, a housing for said filter means, a conduit means pivotally mounted to said housing and extending to said nozzle, said conduit means providing fluid communication between said nozzle and one surface of said filter means, and fluid communication means from the opposite surface of said filter means in said housing to said vacuum generating means.

6. Apparatus according to claim 5 wherein said filter means comprises a cylinder having an interior chamber and disposed in said housing, said conduit means extending from said nozzle provides fluid communication to the exterior of said cylinder, and said communication means from said housing provides fluid communication from the interior chamber of said cylinder.

7. Apparatus according to claim 5 or claim 6 wherein said filter means comprises an open cell plastic foam supported by a concentrically disposed reticulated metal.

8. Apparatus according to claim 5 or claim 6 wherein said nozzle includes an outwardly disposed annulus having one or more transverse orifices.

9. Apparatus according to claim 8 wherein said nozzle has a longitudinal axis substantially normal to said support surface and said orifices are tapered inwardly relative to the longitudinal axis of the nozzle.

10. In an apparatus for cutting sheet material comprising a cutting table including an air-permeable support surface for said sheet material; a vacuum chamber disposed below said support surface; carrier means, including cutting means, supported above said support surface for longitudinal and transverse movement relative to said table; and vacuum generating means including fluid communication means to said vacuum chamber for applying a vacuum to hold down said sheet material on said support surface during cutting operation; the improvement comprising:

(a) sweeper means having a nozzle mounted on said carrier means and adaptable for contacting said support surface, and including fluid communication means to said vacuum generating means;

(b) a substantially cylindrical filter means disposed intermediate said nozzle and said vacuum generating means, (c) housing for said filter means, said filter means concentrically disposed in said housing, (d) conduit means mounted to said housing and extending from said nozzle to provide fluid communication to said housing at one surface of said filter means, (e) fluid communication means from the opposite surface of said filter means in said housing to said vacuum generating means, and (f) valve means for cutting off vacuum to said vacuum chamber and opening vacuum to said sweeper means for cleaning said support surface.

11. Apparatus according to claim 10 wherein said filter means comprises an open cell plastic foam supported by a concentrically disposed reticulated metal.

12. Apparatus according to claim 10 or claim 11 wherein said nozzle includes an outwardly disposed annulus having one or more transverse orifices.

13. Apparatus according to claim 12 wherein said nozzle has a longitudinal axis substantially normal to said support surface, and said orifices are angled inwardly relative to the longitudinal axis of the nozzle.

* * * * *